US007712686B2

(12) United States Patent
Yamamoto

(10) Patent No.: US 7,712,686 B2
(45) Date of Patent: May 11, 2010

(54) FUEL INJECTION VALVE

(75) Inventor: Shinsuke Yamamoto, Kariya (JP)

(73) Assignee: Denso Corporation, Kariya (JP)

( * ) Notice: Subject to any disclaimer, the term of this patent is extended or adjusted under 35 U.S.C. 154(b) by 203 days.

(21) Appl. No.: 11/200,157

(22) Filed: Aug. 10, 2005

(65) Prior Publication Data

US 2006/0055493 A1 Mar. 16, 2006

(30) Foreign Application Priority Data

Sep. 13, 2004 (JP) ..... 2004-265251

(51) Int. Cl.
*F02M 51/00* (2006.01)

(52) U.S. Cl. ..... 239/585.1; 239/585.5; 251/129.21; 335/299; 335/282; 336/225

(58) Field of Classification Search ..... 239/585.1, 239/585.4, 585.5; 251/129.15, 129.21; 335/299, 335/282; 336/225, 222, 231
See application file for complete search history.

(56) References Cited

U.S. PATENT DOCUMENTS 5,375,738 A * 12/1994 Walsh et al. ..... 222/1
5,769,391 A 6/1998 Noller et al.
5,944,262 A 8/1999 Akutagawa et al.
6,367,769 B1 4/2002 Reiter
6,394,367 B2 * 5/2002 Munezane et al. ..... 239/533.12
6,536,681 B2 * 3/2003 Dallmeyer et al. ..... 239/5
6,561,482 B2 * 5/2003 Okii ..... 251/129.15
6,616,071 B2 * 9/2003 Kitamura et al. ..... 239/533.12
6,662,976 B2 * 12/2003 Jensen et al. ..... 222/481.5
6,669,116 B2 * 12/2003 Iwase ..... 239/533.12
6,678,955 B2 * 1/2004 Takeshita et al. ..... 29/890.142
6,779,743 B2 * 8/2004 Kitamura ..... 239/533.12
6,851,630 B2 * 2/2005 Nagaoka et al. ..... 239/585.1

(Continued)

FOREIGN PATENT DOCUMENTS

EP 1340907 9/2003

(Continued)

OTHER PUBLICATIONS

Chinese Official Action dated May 18, 2007 issued in corresponding Chinese Application No. 200510098186.X with English translation.

(Continued)

*Primary Examiner*—Steven J Ganey
(74) *Attorney, Agent, or Firm*—Nixon & Vanderhye PC

(57) ABSTRACT

A fuel injection valve includes a valve member for regulating a flow of a fuel to a nozzle hole, a movable core axially slidable in an integrated body with the valve member, a fixed core being faced by an end of the movable core, and a coil portion having an increasing number of winding of a winding wire toward the movable core in a bobbin to have a magnetic attractive force between the movable core and the fixed core upon application of an electric current. The number of winding wire increases toward an end on a movable core side in the coil portion. Therefore, the generated magnetic field increases on the movable core side. In this manner, the magnetic attractive force between the fixed core and the movable core is increased without increasing a cross-section and/or a body of the movable core.

9 Claims, 5 Drawing Sheets

U.S. PATENT DOCUMENTS 6,908,050 B2 * 6/2005 Sekine et al. ..... 239/585.1

FOREIGN PATENT DOCUMENTS

JP 03-171602 7/1991

JP 2004-156479 6/2004

OTHER PUBLICATIONS

Japanese Official Action dated Jan. 10, 2008 issued in corresponding Japanese Application No. 2004-265251 with English translation.

Indian Office Action dated Feb. 6, 2009, issued in corresponding Indian Application No. 1282/CHE/2005.

* cited by examiner

FUEL INJECTION VALVE

CROSS REFERENCE TO THE RELATED APPLICATION

This application is based on and claims the benefit of priority of Japanese Patent Application No. 2004-265251 filed on Sep. 13, 2004, the disclosure of which is incorporated herein by reference.

FIELD OF THE INVENTION

This invention relates to a fuel injection valve that injects a fuel into an internal-combustion engine.

BACKGROUND OF THE INVENTION

Conventional fuel injection valves are disclosed in Japanese Patent Documents. The conventional fuel injection valves disclosed therein actuate a valve member by an electromagnetic force between a fixed core and a movable core that slidably moves in an axially reciprocating motion. The electromagnetic force between the fixed core and the movable core can be increased by increasing a cross-sectional area of those cores (refer to a Japanese Patent Document JP-A-H11-500509, and a Japanese Patent Document JP-A-2002-528672). The increased cross-sectional area of the fixed core and the movable core receives an increased amount of magnetic flux. Therefore, the fixed core 34 and the movable core attract each other by an increased magnetic attractive force.

However, the increased cross-sectional area of the movable core leads to an increased mass. The increased mass of the movable core deteriorates responsiveness of the movable core when a current is supplied to actuate the movable core. As a result, an amount of injected fuel cannot be precisely controlled.

SUMMARY OF THE INVENTION

The object of the present invention is to provide a fuel injection valve that has high responsiveness in actuation to precisely deliver a desired amount of fuel by using an increased magnetic attractive force between the fixed core and the movable core.

The fuel injection valve of the present invention has a coil portion where the number of windings of winding wire increases toward the movable core side in the coil. The magnetic attractive force between the fixed core and the movable core relates to the amount of magnetic flux generated between the fixed core and the movable core. The increase in number of windings of the winding wire on the movable core yields the increase of magnetic flux between the fixed core and the movable core, thereby increases the magnetic attractive force applied therebetween. Further, the amount of the magnetic flux spilled in the fixed core of the coil decreases as the number of windings of the winding wire decreases at a distance from the movable core because of a radially dispersing distribution of the magnetic flux in the coil. That is, the amount of the magnetic flux between the fixed core and the movable core increases when the number of windings of the winding wire on the coil increases toward the movable core side. In this manner, the magnetic attractive force between the fixed core and the movable core can be increased without increasing the cross-sectional area of the movable core for increased reception of the magnetic flux. Therefore, improved preciseness of the amount of the injected fuel can be achieved based on the improvement of the responsiveness of the movable core that has the same amount of mass for increased reception of the magnetic flux.

The fuel injection valve of the present invention has the coil portion that is formed in a trapezoid shape or in a triangular shape in an axial cross section. In this manner, the axial cross section of the coil portion has a longer radius toward the movable core side. A cross-sectional area of the coil portion that is perpendicular to the axis of the coil portion also increases toward the movable core side. Therefore, the amount of the magnetic flux between the fixed core and the movable core is smoothly increased to totally yield the increased amount of the magnetic attractive force between those cores.

The fuel injection valve of the present invention has the coil portion that has an outer circumference being tilted against the axis of the coil portion. In this manner, an inner circumference of the bobbin can be made substantially parallel to the axis of the coil when the cross section of the coil has a trapezoid form or a triangular form. Therefore, the coil portion and the fixed core can be arranged in a close proximity. That is, the magnetic attractive force between the fixed core and the movable core will be increased in this manner.

The coil portion of the conventional fuel injection valve has a cylindrical shape. Therefore, a magnetic member that covers the coil portion has to be cylindrically shaped with both axial ends extending radially inward toward the axis of the coil portion. However, it is difficult to integrally mold the magnetic member of the above-described shape. That is, the process of integrally molding the above-described shape requires more steps. Thus, the magnetic member is formed by an upper part and a lower part in the axial direction for the ease of the molding process of each part. As a result, the increased number of parts of the coil portion creates inconvenience in manufacturing process. The fuel injection valve of the present invention has the coil portion that has the winding wire being increased in the number of windings toward the movable core side. Therefore, the coil portion has the outer circumferential surface being tilted against the axis of the coil. As a result, the coil portion approximately has a conically cylindrical shape. In this manner, a holder and a housing that cover the coil portion can be easily formed in molding, thereby being integrally molded to contribute to the decrease of the number of parts.

The fuel injection valve of the present invention has an integrally molded holder and housing having a window on its circumference. That is, the integrated holder and housing has an umbrella like shape having an opening on its circumference. Therefore, the integrated holder and housing can be easily placed on an outside of the coil portion. Thus, the number of parts can be decreased to have a simple structure.

The fuel injection valve of the present invention has the bobbin and the winding wire in the coil portion. The winding wire has an increased number of windings from one end toward the other end. Therefore, the coil portion of the fuel injection valve has a different number of windings of the winding wire in a different axial position. In this manner, the winding wire yields a greater magnetic field on an end having a greater number of windings of the winding wire when an electric current is supplied to the coil portion. The magnetic field of the other end that has a fewer number of windings spills the smaller amount of the magnetic flux.

BRIEF DESCRIPTION OF THE DRAWINGS

Other objects, features and advantages of the present invention will become more apparent from the following detailed description made with reference to the accompanying drawings, in which.

DETAILED DESCRIPTION OF THE PREFERRED EMBODIMENTS

Embodiments of the present invention will be described with reference to the drawings.

First Embodiment

Figure 1:
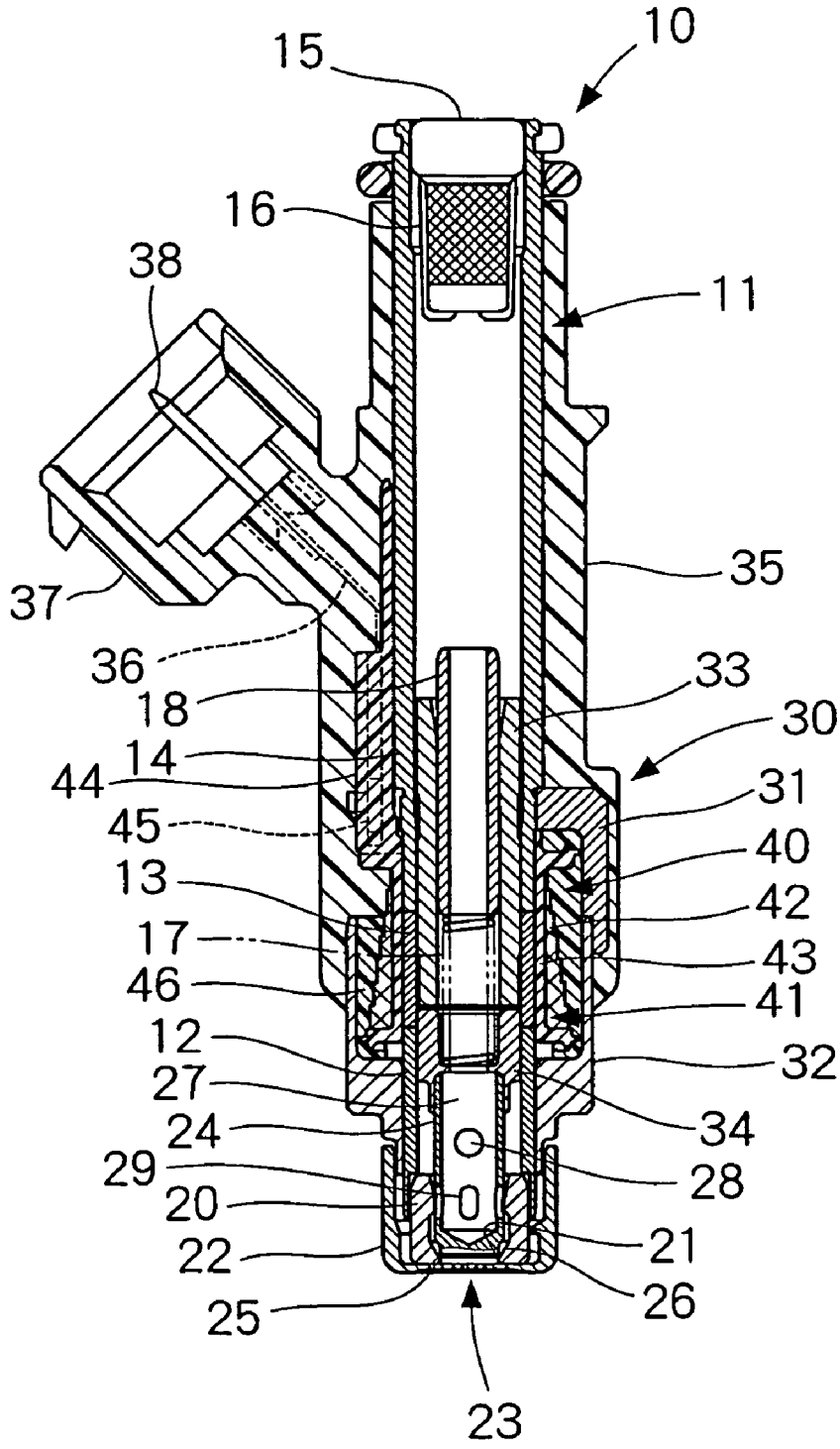
FIG. 1 is a cross-section of an injector in a first embodiment of the present invention.

A fuel injection valve in a first embodiment of the present invention is shown in FIG. 1 (The fuel injection valve is called as 'Injector' hereinafter). The injector 10 in the first embodiment injects, for example, a fuel into an intake air provided to a combustion chamber of a gasoline engine. The injector 10 may be used in a direct-gasoline injection engine that directly injects gasoline into the combustion chamber, or may be used in a diesel engine.

A reception pipe 11 of the injector 10 has a thin-walled cylindrical shape. The reception pipe includes a first magnetic portion 12, a non-magnetic portion 13 and a second magnetic portion 14. The non-magnetic portion 13 prevents magnetic short-circuit between the first magnetic portion 12 and the second magnetic portion 14. The reception pipe 11 has a fuel port 15 on one end. The fuel port 15 receives a fuel from a fuel pump not shown in the figure. The fuel provided to the fuel port 15 flows into the reception pipe 11 through a fuel filter 16. The fuel filter 16 is disposed on the end of the reception pipe 11 to filter foreign matter in the fuel.

A valve body 20 is disposed on an inner circumference of the first magnetic portion 12 that is opposite to the fuel port 15 of the reception pipe 11. The valve body 20 is formed in an approximately cylindrical shape, and is fixed on an inner wall of the first magnetic portion 12. The valve body 20 has a valve seat 21 on a conical inner wall whose radius decreases toward a pointed end. The valve body 20 has a nozzle plate 22 on an end that is opposite to the reception pipe 11. The nozzle plate 22 has a nozzle hole 23 that connects a face on the valve body 20 side of the nozzle plate 22 and a face on the opposite side of the nozzle plate 22.

A needle 24 as a part of a valve member is accommodated in the first magnetic portion 12 and the valve body 20. The needle 24 is disposed substantially coaxially with the reception pipe 11 and the valve body 20. The needle 24 has a seal portion 25 in a proximity of an end on the nozzle plate 22 side. The seal portion 25 abuts on a valve seat 21 formed on the valve body 20. The needle 24 and the valve body 20 define a fuel vessel 26. The seal portion 25 of the needle 24 takes off from the valve seat 21 for the fuel vessel 26 to communicate with the nozzle hole 23. The needle 24 in the present embodiment is formed in a cylindrical shape. The needle 24 includes a fuel vessel 27 formed therein. The needle 24 also includes a fuel hole 28 and 29 for letting the fuel pass between the fuel vessel 27 and the fuel vessel 26. The needle 24 may be formed in a cylindrical shape having a void formed therein or having no void.

The injector 10 includes an actuator 30 for actuating the needle24. The actuator 30 electro-magnetically actuates the needle 24. The actuator 30 includes a coil portion 40, a housing 31, a holder 32, a fixed core 33 and a movable core 34. The housing 31 and the holder 32 are made from a magnetic material. The housing 31 covers an outer surface of the coil portion 40. The holder 32 is disposed outside of the reception pipe 11, and supports the coil portion 40 on the nozzle hole 23 side. The housing 31 and the holder 32 are made from a magnetic material, and are magnetically connected. The coil portion 40, the housing 31, the holder 32 and the reception pipe 11 are covered by a resin mold 35 on their outer surface. The coil portion 40 is electrically connected to a terminal 38 on a connector 37 through wiring 36.

The fixed core 33 is fixed on an inner side of the coil portion 40 having the reception pipe 11 bound therebetween. The fixed core 33 is formed in an approximately cylindrical shape by using a material such as an iron or the like. The fixed core 33 is disposed with a gap toward the movable core 34. The size of the gap between the fixed core 33 and the movable core 34 corresponds to a lift of the needle 24.

The movable core 34 is accommodated in an inner side of the reception pipe 11. The movable core 34 is slidable in an axial direction of the reception pipe 11. The movable core 34 is formed in an approximately cylindrical shape by using a material such as an iron or the like. The needle 24 is fixed on an inner side of the movable core 34 by an end that is opposite to the seal portion 25. In this manner, the needle 24 and the movable core 34 integrally move in the axial direction in a reciprocating motion.

The movable core 34 abuts on a spring 17 that serves as an elastic member. The spring 17 is in contact with the movable core 34 on one end, and is in contact with an adjusting pipe 18 on the other end. The adjusting pipe 18 is fixed on an inner side of the fixed core 33. The spring 17 has an extending force in an axial direction. Therefore, the spring 17 having a fixed end presses the movable core 34 and the needle 24 in a mass toward the valve seat 21 on the other end. Lord of the spring 17 is controlled by adjustably press-fitting the adjusting pipe 18 into the fixed core 33. The movable core 34 and the needle 24 are pressed in a mass toward the valve seat 21 when no electric current is supplied to the coil portion 40. In this manner, the seal portion 25 abuts on the valve seat 21.

Next, the coil portion 40 is described in detail.

Figure 4:
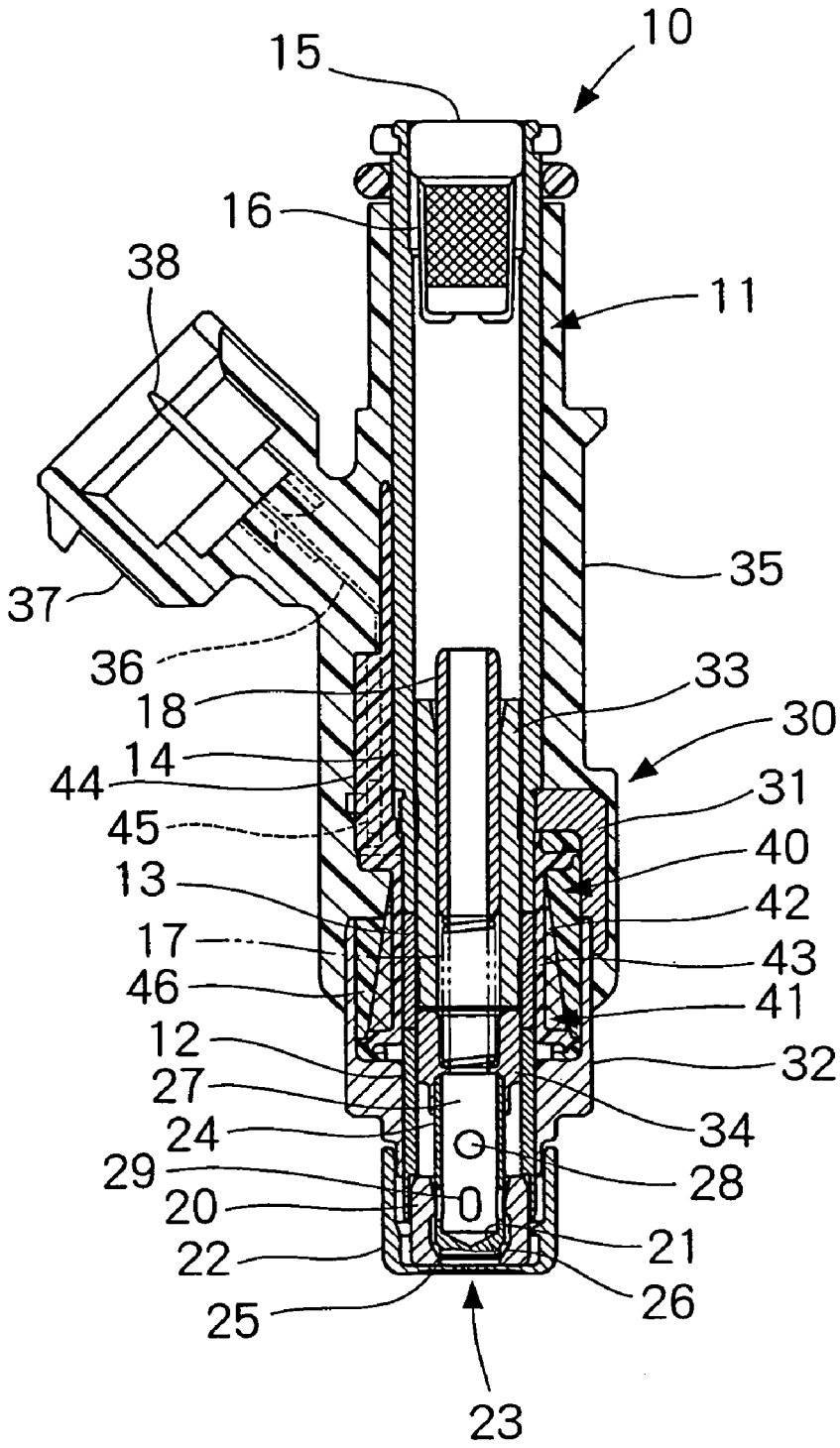
FIG. 4 is a modification of the injector in the first embodiment of the present invention.

The coil portion 40 includes a bobbin 41 and a winding wire 42. The bobbin 41 is formed in a cylindrical shape by using a resin. The bobbin 41 includes a cylinder portion 43 and a support portion 44 as shown in FIG. 4. The cylinder portion 43 has a cylinder shape, and has a winding wire 42 on an outer surface. The support portion 44 rises in an axial direction from the cylinder portion 43. The support portion 44 holds wiring 45 as shown in FIG. 1. The wiring 45 is electrically connected to the winding wire 42 on one end, and is connected to the wiring 36 on the other end. The wiring 42 is made of a publicly known conductive material, and is wound on an outer surface of the cylinder portion 43. The coil portion 40 is disposed on an outer side of the fixed core 33 having the reception pipe 11 bound therebetween. The cylinder portion 43 of the bobbin 41 receives the reception pipe 11. Gap between the winding wire 42, the housing 31 and the holder 32 is filled with a resin 46. The resin 46 insulates the winding wire 42 from the housing 31 and the holder 32.

Figure 2:
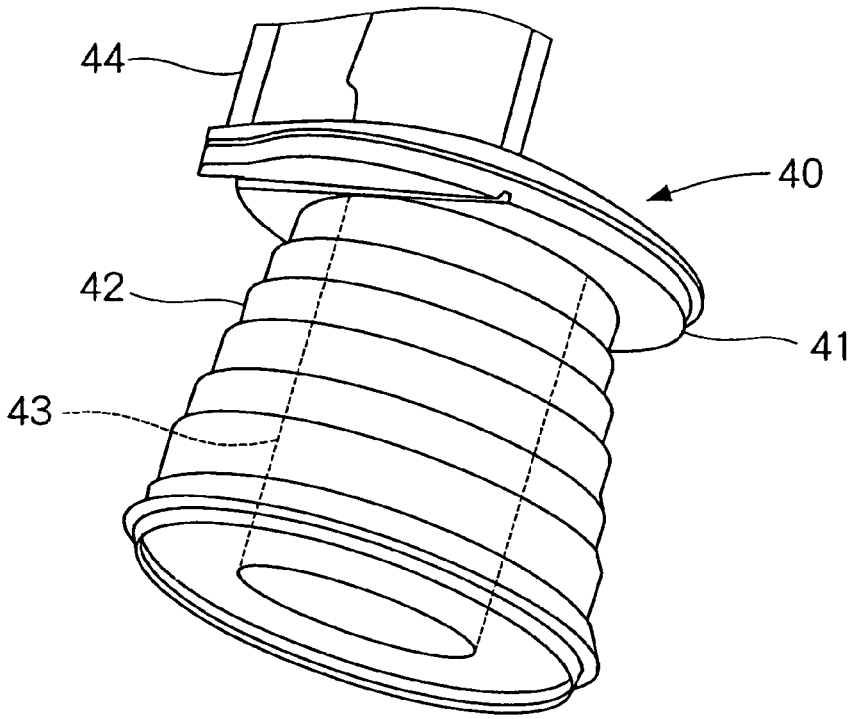
FIG. 2 is a schematic perspective view of a coil portion of the injector in the first embodiment.

The winding number of the winding wire 42 wound on the bobbin 41 changes from one end to the other end in an axial direction. The winding wire 42 in the present embodiment has a smaller winding number of the winding wire 42 on one end of the axis. That is, the coil portion 40 assembled to the injector 10 has a greater winding number of the winding wire 42 on the movable core 34 side. Therefore, the coil portion 40 has an approximately conically cylindrical shape, or has an approximately truncated conical shape as shown in FIG. 2. The winding number of the winding wire 42 increases stepwise in an axial direction as shown in FIG. 1. Thus, the coil portion 40 has an axial cross section of an approximately trapezoid shape.

The coil portion 40 is substantially in a conical shape. That is, outline of the winding wire 42 is tilted against an axis of the coil portion 40. The tilted outer side of the winding wire 42 makes it possible to have the cylinder portion 43 of the bobbin 41 to be parallel with the axis of the coil portion 40. The cylinder portion 43 can be put in a proximity of the outer surface of the reception pipe 11. In this manner, the coil portion 40 and the fixed core 33 sits close to each other. Thus, spill of magnetic flux generated therein is decreased and most of the magnetic flux generated therein penetrates the fixed core 33 smoothly.

The increased number of windings of the winding wire 42 towards the movable core 34 generates a greater electromagnetic attractive force between the fixed core 33 and the movable core 34 when the current is supplied to the coil portion 40. The magnetic attractive force between the fixed core 33 and the movable core 34 is related to an amount of the magnetic flux between the two cores 33 and 34. The amount of the magnetic flux increases when the number of windings of the winding wire 42 increases. Therefore, the magnetic flux between the fixed core 33 and the movable core 34 can be increased by increasing the number of windings of the winding wire 42 on the movable core 34 side. The magnetic attractive force between the fixed core 33 and the movable core 34 can be increased in this manner.

The magnetic flux of the coil portion 40 flows radially outwardly. Therefore, an even distribution of the winding wire 42 in the axial direction creates an even reception of the magnetic flux that flows from the coil portion 40 to the fixed core 33. The magnetic flux received by the fixed core 33 in a remote position from the movable core 34 does not contribute much to the magnetic attractive force between fixed core 33 and the movable core 34. As a result, the even distribution of the winding wire 42 in the axial direction makes the amount of the spill of the magnetic flux more substantially to the contribution to the magnetic attractive force in the remote position of from the movable core 34. Therefore, decrease of the winding number of the winding wire 42 in the remote position from the movable core 34 create less amount of the spill of the magnetic flux to the fixed core 33. That is, the number of windings of the winding wire 42 can be increased to have a relative increase of the amount of the magnetic flux between the fixed core 33 and the movable core 34.

Relationship between the number of windings of the winding wire 42 and the magnetic attractive force between the fixed core 33 and the movable core 34 is explained with reference to FIG. 3. A comparative example 1 (broken line) is yielded from a coil portion that has an even distribution of the winding wire in the axial direction. A comparative example 2 (dashed line) is yielded from a coil portion that has an increased number of windings on a far side from the movable core 34, which is contrary to the present embodiment of the invention. A total number of windings of the winding wire is the same in all of the present invention, the comparative example 1 and the comparative example 2.

Figure 3:
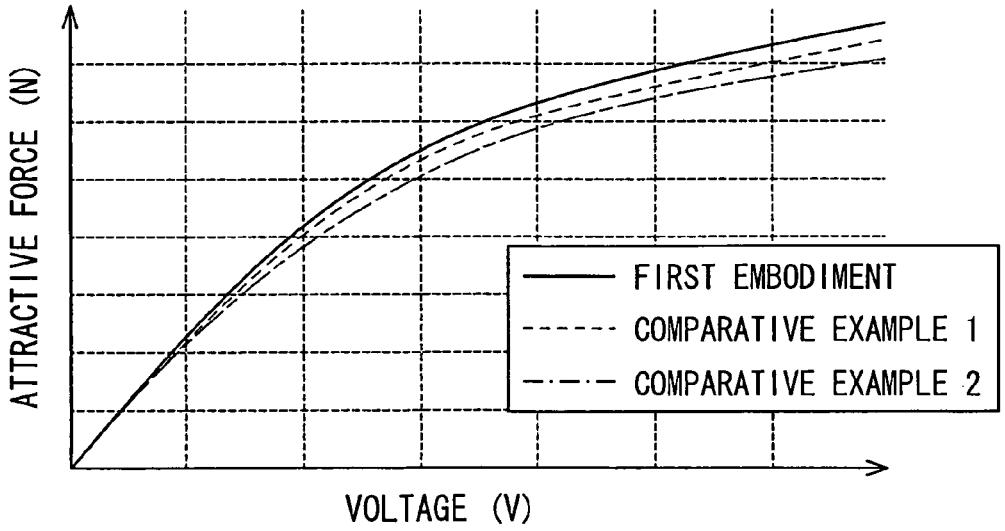
FIG. 3 is a diagram of a relationship between a voltage applied to the coil portion and a magnetic attractive force.

The coil portion 40 in the present invention in FIG. 3 generates a greater magnetic attractive force than the comparative example 1 or the comparative example 2. Further, the magnetic attractive force in the comparative example 1 is greater than that of the comparative example 2. The windings of the winding wire 42 on the movable core 34 side is greatest in number in the present embodiment, and smallest in number in the comparative example 2, with the comparative example 1 in between. Therefore, the magnetic attractive force becomes stronger when the number of windings on the movable core 34 side is greater.

Operation of the injector 10 described above is explained.

The fixed core 33 and the movable core 34 do not magnetically attract each other when an electric current is not supplied to the coil portion 40. Therefore, the movable core 34 moves away from the fixed core 33 by a force applied by the spring 17. That is, the movable core 34 and the needle 24 in a mass move away from the fixed core 33. Therefore, the seal portion 25 of the needle 24 is seated on the valve seat 21. In this manner, injection of the fuel from the nozzle hole 23 is stopped.

The electric current supplied to the coil portion 40 generates the magnetic field to create the magnetic flux in the housing 31, the second magnetic portion 14, the fixed core 33, the movable core 34, the first magnetic portion 12 and the holder 32. Therefore, the magnetic attractive force is generated between the fixed core 33 and the movable core 34 being separated by a force applied by the spring 17 when the electric current is supplied to the coil portion 40. The movable core 34 and the needle 24 in a mass take off from the valve seat 21 toward the fixed core 33 when the magnetic attractive force conquers the force from the spring 17. That is, the seal portion 25 of the needle 24 takes off from the valve seat 21. The movable core 34 and the needle 24 integrally move up until the movable core 34 abut on the fixed core 33 in FIG. 1.

The fuel provided to the fuel port 15 flows into the injector 10 through the fuel filter 16, the inner side of the reception pipe 11, the inner side of the adjusting pipe 18, the inner side of the fixed core 33, the inner side of the movable core 34, the fuel vessel 27 on the inner side of the needle 24, the fuel hole 28 and 29 toward the fuel vessel 26. The fuel in the fuel vessel 26 further flows toward the nozzle hole 23 from the gap between the needle 24 and the valve body 20 taking off from the valve seat 21. In this manner, the fuel is injected from the nozzle hole 23.

The magnetic attractive force between the fixed core 33 and the movable core 34 disappears when the electric current to the coil portion 40 is interrupted. Then, the movable core 34 and the needle 24 in a mass move in a direction that is opposite to the fixed core 33 by the force applied by the spring 17. Therefore, the seal portion 25 abuts on the valve seat 21, and the flow of the fuel between the fuel vessel 26 and the nozzle hole 23 is stopped. As a result, injection of the fuel is stopped.

The coil portion 40 in the first embodiment has the greater number of windings of the winding wire 42 on the movable core 34 side. Therefore, the magnetic field generated therefrom is greater on the movable core 34 side. In this manner, the magnetic attractive force between the fixed core 33 and the movable core 34 increases. Therefore, the magnetic attractive force between the fixed core 33 and the movable core 34 can be increased without increasing a cross sectional area or a volume of the movable core 34. That is, the weight of the movable core 34 does not increase. The movable core 34 is made lighter in this manner, thereby the movable core 34 and the needle 25 in a mass has an improved responsiveness. Further, the improved responsiveness of the movable core 34 and the needle 24 in a mass contributes to a precise control of an amount of the injected fuel by promptly opening and closing the gap between the fuel vessel 26 and the nozzle hole 23.

Modification

Figure 5:
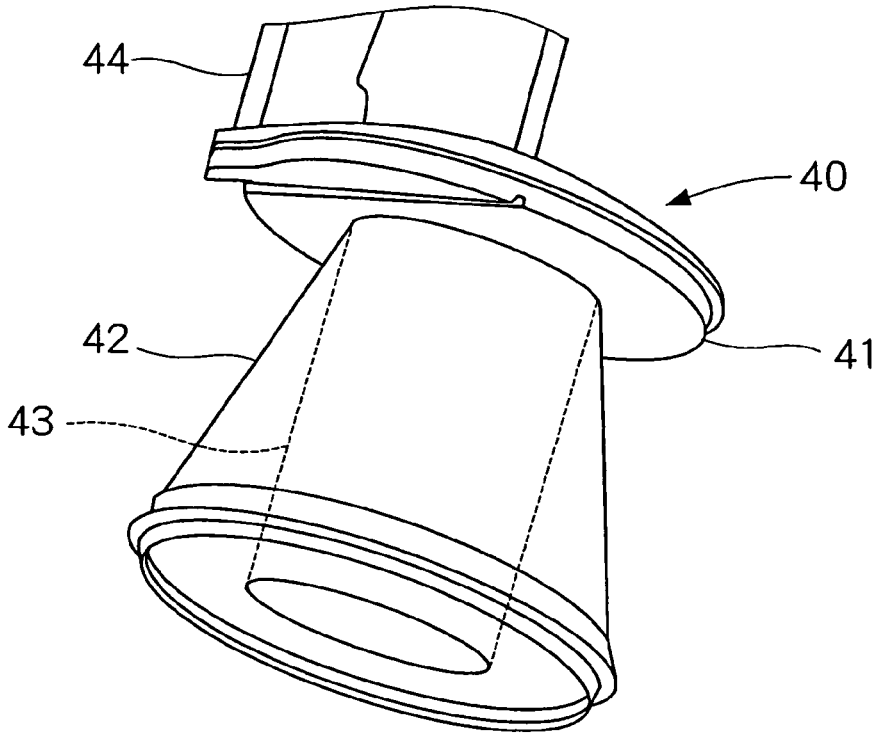
FIG. 5 is a schematic perspective view of a modification of the coil portion of the injector in the first embodiment of the present invention.

Modification of the first embodiment is shown in FIGS. 4 and 5.

The number of windings of the winding wire 42 gradually changes in coil portion 40 in an axial direction. An axial cross section of the coil portion 40 has a triangular shape in a part that bears the winding wire 42. In this manner, the coil portion 40 is formed in a conical outer shape.

Second Embodiment

Figure 6:
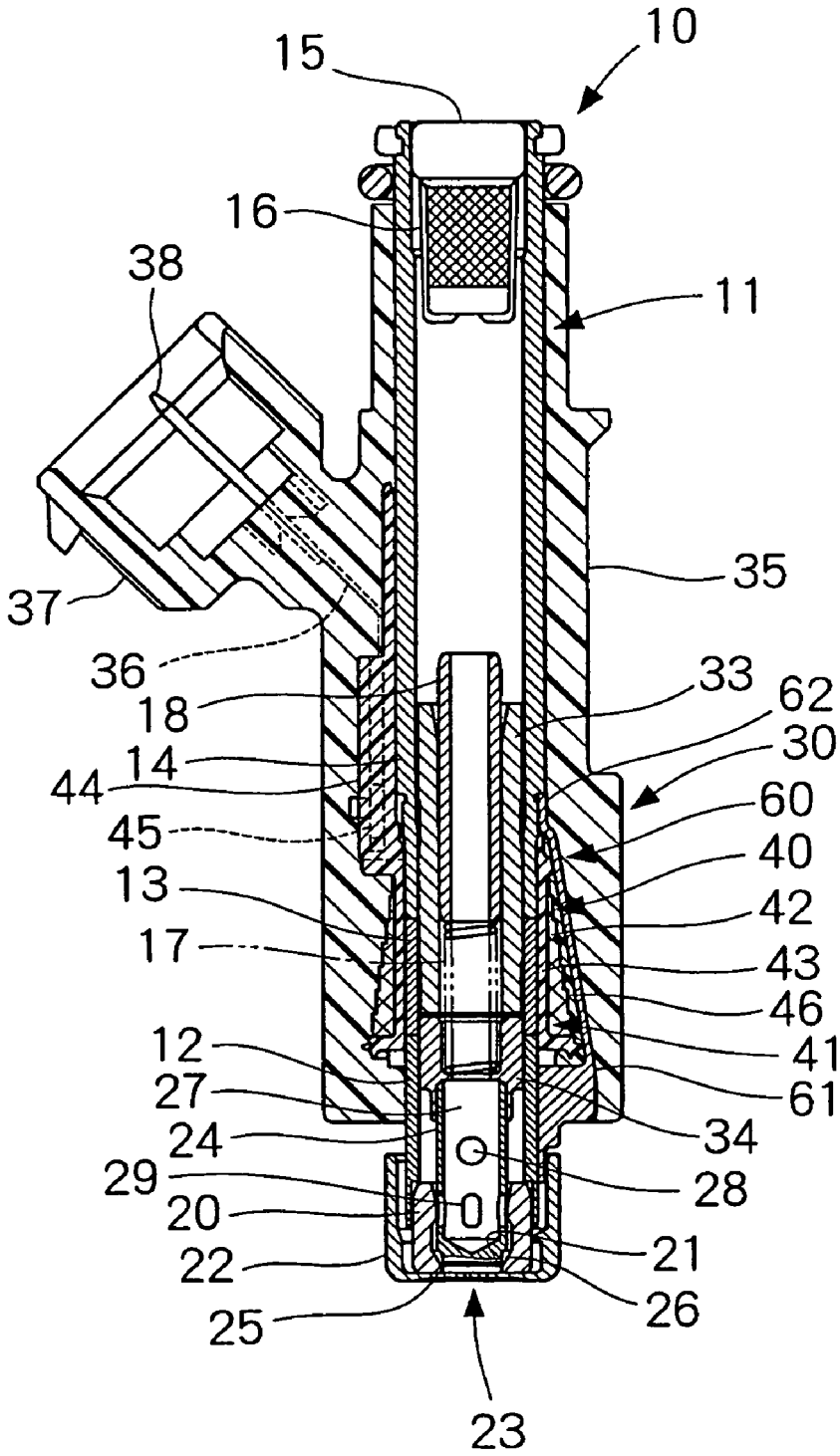
FIG. 6 is a cross-section of the injector in a second embodiment of the present invention.

The injector 10 in a second embodiment of the present invention is shown in FIG. 6. Like parts have like numbers as used in the first embodiment, and descriptions of the like parts are omitted.

Figure 7:
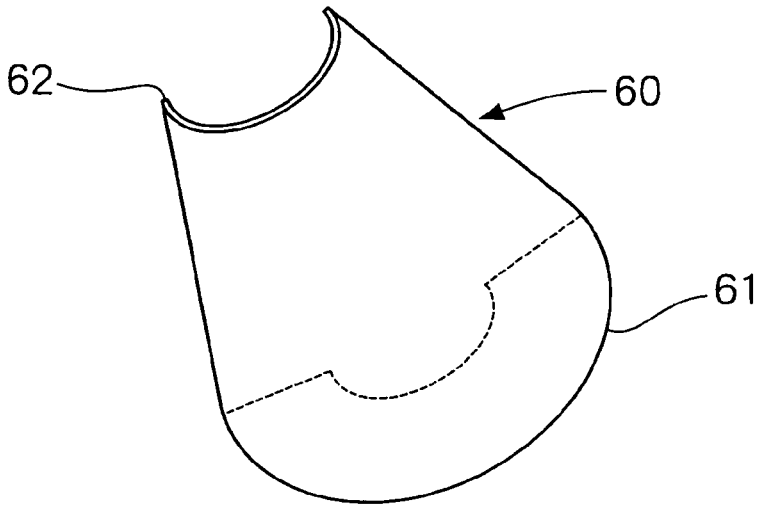
FIG. 7 is a schematic perspective view of a magnetic member of the injector in the second embodiment of the present invention.

The coil portion 40 has a magnetic member 60 on an outer surface. The magnetic member 60 is made of a magnetic material. The magnetic member 60 has two ends, that is, one end 61 in an axial direction that is in contact with the first magnetic portion 12 of the reception pipe 11, and the other end 62 that is in contact with the second magnetic portion 14. In this manner, the magnetic member 60 is magnetically connected to the first magnetic portion 12 and the second magnetic portion 14 of the reception pipe 11. That is, the magnetic member 60 includes the housing 31 and the holder 32 in the first embodiment in an integrated form. Further, the magnetic member 60 accommodates the coil portion 40 in the body. The magnetic member 60 has an opening in a circumferential direction as shown in FIG. 7. In this manner, the magnetic member 60 partially covers the coil portion 40 in the circumferential direction.

The magnetic member 60 is formed in a shape that fits an outer circumference of the coil portion 40. Therefore, an inner radius and an outer radius of the magnetic member 60 at an end 61 on the first magnetic portion 12 side are greater than the inner radius and the outer radius at an end 62 on the second magnetic portion 14 side. As a result, the magnetic member 60 takes a conically cylindrical shape having an opening in a circumferential direction, that is, an umbrella like shape with an opening in the circumferential direction. The coil portion 40 is accommodated in a cylindrical magnetic member 60.

The coil portion 40 has a greater number of windings of the winding wire 42 on the movable core 34 side as in the first embodiment. Therefore, the coil portion 40 has a conical shape having a tilted outer side against the axis. The magnetic member 60 can be formed in a conically cylindrical shape with the coil portion 40 formed in a conical shape. The magnetic member 60 has a conically cylindrical shape for the ease of molding.

The magnetic member 60 must be formed in a cylindrical shape when the coil portion 40 is formed in a cylindrical shape. However, the magnetic member 60 formed in the cylindrical shape must have a sector form extending inward on both ends in an axial direction of the cylindrical shape. That is, the magnetic member 60 in the cylindrical shape takes a complicated form, and the cylindrical shape is difficult to be formed in an integral molding. Therefore, the magnetic member in the conventional injector is divided into two parts, that is, the housing and the holder in an upper axial direction and a lower axial direction.

However, the coil portion 40 in the present embodiment is formed in a conical shape. Therefore, the magnetic member 60 is formed in a conically cylindrical shape with an opening in the circumferential direction. That is, the magnetic member 60 can be integrally formed without a seam.

The magnetic member 60 that covers the coil portion 40 in the second embodiment is integrally formed without a seam in the axial direction. Therefore, structure of the injector 10 is simplified, and the number of parts in the injector 10 is decreased.

Although the present invention has been fully described in connection with the preferred embodiments thereof with reference to the accompanying drawings, it is to be noted that various changes and modifications will become apparent to those skilled in the art.

For example, the nozzle hole 23 may be disposed directly on the valve body 20, instead of the nozzle hole 23 formed in the nozzle hole plate 22 at an end of the valve body 20 in the above-described embodiments.

Further, the winding wire 42 has an even thickness in the above-described embodiments. Therefore, the conical shape is formed by increasing the number of windings on the movable core 34 side in the coil portion 40. However, the thickness of the winding wire 42 may be made thinner toward the movable core 34 side to form a substantially cylindrical shape of the coil portion 40 having an increased number of windings of the winding wire 42 on the movable core 34 side.

Further, the needle is used as the valve member in the above-described embodiments. However, the valve member may be formed in an arbitrary form such as a ball valve or the like.

Such changes and modifications are to be understood as being within the scope of the present invention as defined by the appended claims.

What is claimed is:

1. A fuel injection valve comprising:

a valve member for regulating a flow of a fuel being provided to a nozzle hole;

a movable core being axially slidable with the valve member;

a fixed core being faced by an end of the movable core, the end being on an opposite side of the movable core relative to the valve member;

a coil portion having an increasing number of winding of a winding wire toward the movable core in a bobbin for generating a magnetic field that yields a magnetic attractive force between the movable core and the fixed core upon reception of an electric current; and a cylindrical reception pipe for housing the movable core and the fixed core therewithin, wherein an inner diameter of the coil portion is constant along a longitudinal axis of the coil portion, and wherein the fixed core axially faces the end of the movable core at a location between both axial ends of the coil portion.

2. The fuel injection valve according to claim 1, wherein a radius of the coil portion in an axial cross-section increases toward the movable core to form a trapezoid shape.

3. The fuel injection valve according to claim 1, wherein an axial cross-section of the coil portion is formed in a triangular shape having a lower base on the movable core side.

4. The fuel injection valve according to claim 2, wherein a side face of the coil portion has an angle against an axis of the fuel injection valve.

5. The fuel injection valve according to claim 4 further comprising:

a reception pipe having the movable core and the fixed core held therein;

a holder holding an end of the coil portion on the nozzle hole side, the holder being disposed coveringly on an outer circumference of the reception pipe; and a housing having a magnetic flux of a magnetic field generated by the coil portion, the housing being disposed coveringly on an outer circumference of the coil 30 portion, wherein an integrated body of the holder and the housing being formed without a seam partially covers an outer circumference of the coil portion.

6. The fuel injection valve according to claim 5, wherein the integrated body of the holder and the housing is formed in a conical cylinder shape having an opening on a circumference.

7. The fuel injection valve according to claim 1, wherein the coil portion has an approximately conically cylindrical shape.

8. The fuel injection valve according to claim 1, wherein the increasing number of winding of the winding wire increases step wise in an axial direction toward the movable core.

9. A fuel injection valve having a movable core and a fixed core being disposed to face each other and a coil portion comprising:

a bobbin having a cylindrical shape; and a coil wound on an outer circumference of the bobbin with the number of winding on one axial end being greater than the number of winding on the other axial end, wherein the number of winding of the coil increases from one axial end toward the other axial end that is closer to the movable core; and further comprising:

a cylindrical housing pipe for housing the movable core and the fixed core therewithin, wherein an inner diameter of the coil portion is constant along a longitudinal axis of the coil portion, and wherein the fixed core axially faces the end of the movable core at a location between both axial ends of the coil portion.

* * * * *